United States Patent [19]

Burns

[11] 4,106,832

[45] Aug. 15, 1978

[54] ELECTRICAL GROUNDING CLAMP

[76] Inventor: John Joseph Vincent Burns, P.O. Box 153, Tamworth, Ontario, Canada, K0K 3G0

[21] Appl. No.: 788,819

[22] Filed: Apr. 19, 1977

[51] Int. Cl.[2] ..... H01R 3/06

[52] U.S. Cl. ..... 339/14 L; 339/103 R

[58] Field of Search ..... 339/14 R, 14 L, 13, 339/75 R, 92 R, 103 C, 103 R, 107

[56] References Cited

U.S. PATENT DOCUMENTS

| | | | |
|---|---|---|---|
| 3,009,128 | 11/1961 | De Carlo | 339/13 |
| 3,046,511 | 7/1962 | Rinehuls et al. | 339/14 L X |

*Primary Examiner*—Roy Lake
*Assistant Examiner*—DeWalden W. Jones
*Attorney, Agent, or Firm*—W. Charles Kent

[57] ABSTRACT

An improved means for grounding the electrical service in a building or for grounding motors and the like consisting of an electrical ground fixture comprising a metal pipe section and a securing means for a ground wire integrally associated with the metal pipe section. The securing means comprises a metal casing adapted to receive the ground wire, the casing being integrally connected with and positioned exteriorly on the pipe section. A clamp, operatively associated with the casing and movable with respect thereto is adapted to secure the ground wire in the casing. When the ground wire is secured, a ground path is provided between the wire and the casing and metal pipe section. The pipe section is incorporated into an appropriate part of the water system of the building. Difficulties of installation, corrosion problems and crimping of the pipe occurring with previously used screw-secured plate members fitted about a pipe are avoided according to the present invention.

8 Claims, 4 Drawing Figures

ELECTRICAL GROUNDING CLAMP

BACKGROUND OF THE INVENTION

This invention relates generally to an electrical ground fixture and more particularly concerns a combined pipe and securing means for an electric ground wire of a house or other building.

One present method of grounding the electrical service and equipment in a building in the city is by attaching a wire from the neutral bar and box case to the supply water pipe (copper) ahead of the meter, by means of a ground clamp. The standard ground clamp now in use consists of a pair of plate members formed to fit about a pipe and secured thereon by two screws, one on either side of the plate. A third screw secures the ground wire in position on one of the plate members. Canadian Pat. No. 528,644 of Cutler et al, issued Aug. 7, 1956 illustrates a type of such clamp. Not only does such a clamp require a minimum of three screws to provide the necessary electrical connection, but also, after several years, rust and corrosion are inevitable, the clamp being made of iron or some other such sturdy metal so that galvanic action is set up, thus causing a potential obstacle to the ground path between the ground wire and the supply pipe. Moreover, a strong electrician mounting such a clamp may be able to crimp and distort the copper pipe.

In the country, where water is supplied from a well, in addition to the ground wire being thus clamped to the water pipe, two ground rods are driven into the earth.

Canadian Pat. Nos. 778,512 of Sodderland et al, issued Feb. 13, 1968; 934,458 of Sotolongo, issued Sept. 25, 1973 and 968,431 of Thompson et al, issued May 27, 1975 describe and illustrate other types of ground connectors or clamps which wrap about or straddle a pipe or conduit and to which a ground wire is connected. These references are of general background interest with respect to the present invention. Similarly, background references are the electrical connectors and clamps described and illustrated in Canada Pat. Nos. 403,092 of Mebold, issued Feb. 24, 1942; 451,442 of Bakke, issued Sept. 28, 1948 and 726,298 of Wolf, issued Jan. 18, 1966. Each describes a separate clamping device used to connect together one or more electrical conductors and designed to operate as a separate unit or to be mounted to a panel board (as in the case of Wolf).

It is an object of the present invention to provide a simple, effective means of securing a ground wire from the electrical service of a building to a supply water pipe or other conduit, or to secure a ground wire between a conduit and, for example, a vibrating machine. It is a further object of the present invention to provide an acceptable alternative to the two plate, three-screw ground clamp for securing a ground wire to a water pipe or conduit which will not crimp or distort portions of the pipe, which will be simpler to install and operate, and which may avoid problems of corrosion heretofore prevalent with such clamps.

SUMMARY OF THE INVENTION

In accordance with the present invention, an improved means for grounding the electrical service in a building or for grounding motors and the like is provided which consists of an electrical ground fixture comprising a metal pipe section and a securing means for a ground wire associated with the metal pipe section. The securing means comprises a metal casing adapted to receive the ground wire, the casing being integrally connected with and positioned exteriorly on the pipe section. A clamp, operatively associated with the casing and movable with respect thereto, is adapted to secure the ground wire in the casing. In this way, when the ground wire is secured, a ground path is provided between the wire and the casing and metal pipe section. The pipe section can be incorporated into an appropriate part of the water system of a building, and a ground wire is simply clamped in the metal casing to provide a suitable ground for the building's electrical system.

The clamp means may be a screw movably held in a threaded hole in the casing, with a clamping plate rotatably attached to the screw's lower end inside the casing. The plate may be provided with transverse ridges on its operative side to assist in gripping the ground wire and preventing unintentional dislodging of the ground wire from secured position within the casing. The profile of the inside of the casing, (for example its base), may be such to assist in the gripping of the ground wire between the clamp plate and the inside of the casing.

The ground fixture is preferably made of one solid piece (no solder) of copper or brass. In the city it may be fitted into a building's water piping at the entrance point, ahead of the shut-off valve and water meter, where hydro electrical codes require. In the country, it would be fitted into the water piping near the pressure pump or some suitable location.

Where the clamp consists of a screw and clamp plate, since only one screw is depended upon to provide the tight electrical contact within the casing, a much superior means of securing the ground wire to the pipe system of a building is provided over the two-plate, three-screw clamp presently commonly used. Moreover, where the device is made of copper or brass and soldered or otherwise fitted into the piping system, rust or corrosion are minimized. Also, with the device according to the present invention, there is little or no danger of crimping the pipe.

Where acceptable according to electrical codes or practice, the metal pipe section may be (or may be part of) the main water valve for the building or even the water meter.

In the case of a motor or vibrating machinery, where a flexible ground connection is required and the machinery is grounded to a pipe or conduit, again the electrical ground fixture of the present invention may be incorporated into the conduit and a jumper wire is run between the clamp of the ground fixture and a connection on the motor or machinery. An appropriate metal pipe section, whether it be a short, coupling section or a long section of pipe (e.g. for the supply water lines from the street main to the building) may be extruded together with an appropriate casing to form a single, integral electrical ground fixture in accordance with the invention. Of course where aluminum, galvanized iron or other pipes or conduits are used, the electrical ground fixture may be made entirely from such metals in accordance with the present invention.

BRIEF DESCRIPTION OF THE DRAWINGS

Other objects and advantages of the present invention will become apparent upon reading the following detailed description and upon referring to the drawings in which.

In the drawings, similar features are represented by similar reference numerals.

While the present invention will be described in connection with example embodiments, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 1:
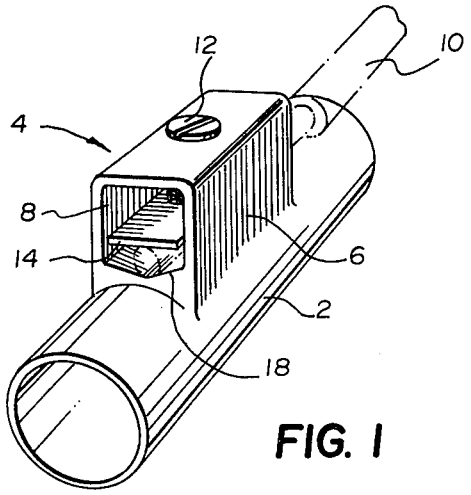
FIG. 1 is a perspective view of an example embodiment of an electrical ground fixture in accordance with the present invention.
Figure 2:
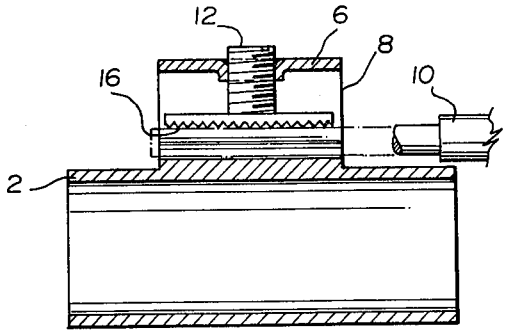
FIG. 2 is a partial section view of an electrical ground fixture along lines II—II of FIG. 1.

Turning now to the drawings, in the example embodiment illustrated in FIGS. 1 and 2, integral with pipe section 2 is securing means 4 comprising a casing 6. At each end of casing 6 is an aperture 8 through which ground wire 10 enters the casing to be secured therein. Screw 12, illustrated to be slot-headed, is threadably engaged in a hole in the upper portion of casing 6. Clamping plate 14 is rotatably attached to the lower end of screw 12 inside the casing. As can be seen in FIG. 2, when screw 12 is turned in the proper direction, clamping plate 14 is lowered to bear against the end of ground wire 10 and secures it tightly between the lower face of the clamping plate and the spaced portion of casing 6. This lower face of clamping plate 14 may be provided with transverse ridges or the like to assist in the engagement with the end of ground wire 10. Also, as can be seen in FIG. 1, the inner surface of base portion 18 of casing 6 has a "wide-V" shaped profile in a transverse direction to assist in securing ground wire 10 in place within the casing.

Figure 3:
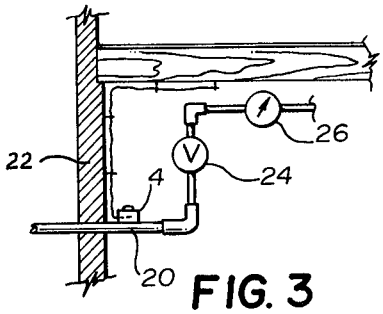
FIG. 3 is a schematic view of a portion of a building's water and electrical system in which an electrical ground fixture according to the present invention has been incorporated.

While metal pipe section 2 may be of any suitable length for securing in a proper place in the water system of a building, it may be preferred that it be towards the building end of a length of delivery pipe for delivering water from a well or city main to a building so that no soldered connections exist between the ground wire securing means and the ground outside the building. This may be required in some electric codes. Such a set-up is illustrated in FIG. 3 where securing means 4 is located towards the inner end of water delivery pipe 20, which is a length of water pipe running directly from city service mains to the inside of building wall 22. Main water valve 24 and meter 26 are located further along the water system in the house. While not illustrated, it is within the scope of the present invention to have securing means 4 integrally connected to a suitable portion of main valve 24 or meter 26 where electrical codes would permit.

Figure 4:
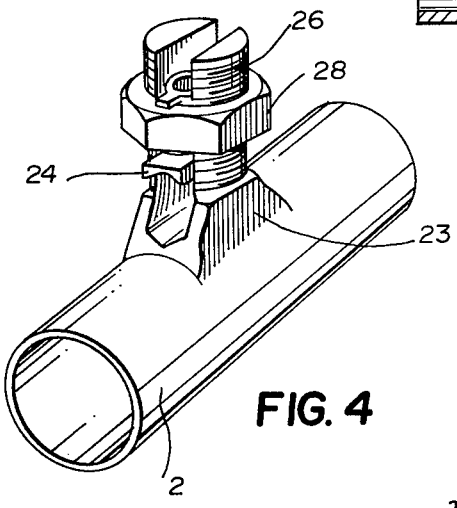
FIG. 4 is a perspective view of a further embodiment of electrical ground fixture according to the present invention.

A further alternative embodiment of the invention, not illustrated, would include a pair of hexagonal-headed screws threaded through the outer wall of an elongated casing, each screw having a clamping plate 14, similar to that of FIGS. 1 and 2, rotatably attached to its lower end. Such a securing means will provide, where required, greater securing strength. Alternatively, as shown in FIG. 4 the metal casing may be in the form of a split bolt 23 integrally secured to pipe 2. Clamping of the wire in position within the casing is achieved by means of clamping plate 24 slidably positioned and secured between the arms 26 of split bolt 23 by means of nut 28.

It will be understood that the words "pipe section" as used throughout this specification include a standard coupling which is usually used to join two lengths of pipe together or a length of pipe itself. Alternatively, "pipe section", within the meaning intended in this specification, may be a threaded coupling, male or female connector, a short nipple of threaded pipe or any plumbing or electrical pipe fitting or device of copper, brass, aluminum, steel, galvanized iron or any other metal used in these trades and suitable to the particular application intended.

Thus it is apparent that there has been provided, in accordance with the present invention, an electrical ground fixture that fully satisfies the objects, aims and advantages as set forth above. While the invention has been described in conjunction with specific embodiments thereof, it is evident that many alternatives, modifications and variations will be apparent to those skilled in the art in light of the foregoing discription. Accordingly, it is intended to embrace all such alternatives, modifications and variations as fall within the spirit and broad scope of the appended claims.

What I claim as my invention is:

1. An electrical ground fixture comprising:
   - a metal pipe section, the section to constitute an intermediate section of a grounded pipe system, and
   - a securing means for a ground wire associated therewith, said securing means comprising:
   - a metal casing adapted to receive the ground wire within, said casing being exterior to and an integral part of said pipe section, and
   - a clamp also part of the pipe section, operatively associated with and movable with respect to said casing, for securing the ground wire within said metal casing, whereby a ground path is provided between the secured ground wire and said casing and metal pipe section.

2. A fixture according to claim 1, wherein said pipe section and casing are of copper or brass.

3. A fixture according to claim 1, wherein said clamp means comprises a screw threadably engaged in a hole in said casing, and a clamping plate rotatably attached to the lower end thereof within said casing.

4. A fixture according to claim 3, wherein said clamping plate is provided with transverse ridges on its operative side to assist in gripping the ground wire.

5. A fixture according to claim 3, wherein said casing is elongated in the direction of the axis of said pipe, each end of the casing being provided with an aperture for receiving the ground wire and wherein a base portion of said casing lies adjacent and integral with said pipe and faces said clamping plate.

6. A fixture according to claim 5, wherein said base of said casing has a "U" or wide -"V" profile in a transverse direction to assist the gripping of said ground wire between said clamp plate and said casing base.

7. A fixture according to claim 1, wherein said metal casing comprises a split bolt, the base of which is integrally connected with and positioned externally on said pipe section, with spaced arms projecting therefrom, and said clamp comprises a clamping plate facing said base and slidably positioned between said arms of said split bolt by means of a nut threaded about the arms of the bolt.

8. A fixture according to claim 1, wherein said metal pipe section is a standard coupling used to join two lengths of pipe together.

* * * * *